United States Patent [19]

Gerwick, Jr. et al.

[11] 4,433,941

[45] Feb. 28, 1984

[54] STRUCTURE FOR OFFSHORE EXPLOITATION

[75] Inventors: Ben C. Gerwick, Jr., Oakland, Calif.; Stephen J. Hatcher, Duncanville, Tex.

[73] Assignee: Mobil Oil Corporation, New York, N.Y.

[21] Appl. No.: 451,372

[22] Filed: Dec. 20, 1982

Related U.S. Application Data

[63] Continuation of Ser. No. 147,998, May 12, 1980, abandoned.

[51] Int. Cl.[3] ..... B63B 35/08; E02B 17/00

[52] U.S. Cl. ..... 405/211; 114/40; 405/224

[58] Field of Search ..... 405/61, 195, 196, 211, 405/217, 224; 114/40, 230, 254, 264, 265

[56] References Cited

U.S. PATENT DOCUMENTS

| | | | |
|---|---|---|---|
| 3,463,271 | 8/1969 | St. Louis | 405/196 X |
| 3,566,608 | 3/1971 | Ramme | 114/265 X |
| 3,577,946 | 5/1971 | Horton . | |
| 3,739,736 | 6/1973 | Carreau et al. . | |
| 3,766,874 | 10/1973 | Helm et al. . | |
| 3,804,369 | 4/1974 | Sutton | 405/196 X |
| 3,837,311 | 9/1974 | Lea . | |
| 3,872,814 | 3/1975 | Rodriguez | 114/40 |
| 3,902,447 | 9/1975 | Slocum | 114/230 |
| 3,905,319 | 9/1975 | Schuh . | |
| 3,934,528 | 1/1976 | Horton et al. . | |
| 3,942,737 | 3/1976 | Luzi | 114/254 X |
| 3,952,527 | 4/1976 | Vinieratos . | |
| 3,972,199 | 8/1976 | Hudson et al. . | |
| 3,982,401 | 9/1976 | Loggins . | |
| 3,983,706 | 10/1976 | Kalinowski | 405/224 |
| 3,986,471 | 10/1976 | Haselton . | |
| 4,048,943 | 9/1977 | Gerwick . | |
| 4,073,144 | 2/1978 | Lea . | |
| 4,075,964 | 2/1978 | Sjogren | 114/40 |

*Primary Examiner*—David H. Corbin

*Attorney, Agent, or Firm*—A. J. McKillop; M. G. Gilman; J. F. Powers, Jr.

[57] ABSTRACT

A structure for use in exploiting arctic offshore areas where floating ice masses may be present. The structure is comprised of a floating hull having ice-breaking capabilities which is moored by a plurality of mooring means which extend vertically from a moonpool in the hull to the marine bottom directly under the hull. The mooring means comprises flexible lines, e.g. nylon, steel, or the like or rigid conduits, e.g. drill pipe.

Means are provided within the moonpool for tensioning the mooring means to thereby draw the hull downward to a position below its normal buoyant position thereby substantially eliminating vertical heaving of the hull. When an ice mass contacts the hull, tension on the mooring means is relaxed to thereby allow the hull to rock upward against the ice thereby generating the forces necessary for the ice-breaking operation. Due to the present mooring means, the hull moves only a relatively short lateral distance in breaking an approaching ice mass. This is important in floating drilling operations.

Further, if repair or replacement of a mooring means is required, this can be accomplished even when ice surrounds the hull since the mooring means are anchored directly below the hull and are easily accessible through the moonpool.

10 Claims, 4 Drawing Figures

STRUCTURE FOR OFFSHORE EXPLOITATION

This is a continuation of copending application Ser. No. 147,998, filed May 12, 1980 abandoned.

BACKGROUND OF THE INVENTION

The present invention relates to an offshore structure for use in an arctic environment and more particularly relates to an offshore structure for use in ice-infested areas which includes a mooring system which is capable of resisting the destructive forces caused by movement of the ice and at the same time, is relatively easy to maintain and service even when the surface is ice covered.

The increasing demand for petroleum products has required exploitation of many new regions throughout the world. One of the most promising of these regions is the arctic areas lying offshore of northern Alaska, Canada, and Greenland. However, obviously the exploitation of such areas present technological problems not normally encountered in the routine offshore exploitation for petroleum.

One obvious problem in exploiting offshore arctic areas lies in coping with the masses of ice which continuously form during certain parts of the year. These ice masses include sheets of ice having thicknesses of eight feet thick or more which may have "pressure ridges" formed therein which may measure 100 feet or more in thickness. These ice masses are not stationary and may move several hundred feet per day under the influence of surface winds and currents. Obviously, these moving ice masses develop substantial forces which, in turn, are normally destructive to any fixed objects lying in the path of the ice masses.

Accordingly, it has been recognized for sometime that bottom-supported structures of the type routinely used in ice free offshore areas are particularly vunerable in arctic offshore areas since the moving ice masses contact the fixed structures near the water line, thereby setting up bending moments which eventually crush or buckle the structure. Various configurations, e.g. an inverted conical platform section, have been proposed for bottom-supported structures which function to break and deflect these ice masses around the structure as the ice moves pass. Examples of such structures are shown in U.S. Pat. Nos. 3,952,527; 3,972,199; 4,075,964; and 4,103,199. However, as the depths of water in the arctic areas increase to 200 meters or more, the practicality of using any bottom supported structure decreases.

In providing arctic offshore structures for use in deep water, several structures have been proposed which in effect comprise a floating frusto-conical shaped or similarly-shaped hull which is either dynamically positioned or is moored in place by a catenary line anchor system; see U.S. Pat. Nos. 3,766,874; 3,837,311; 3,872,814; 3,902,447; 4,073,144.

A typical example of such a floating system is disclosed in U.S. Pat. No. 4,043,943 wherein a floating hull having an upper frusto-conical shape is moored in a deep, ice-infested area by means of a catenary mooring system. The mooring system is designed to permit active heaving of the hull in the water to thereby use the hull itself, to break the contacting ice. While this type structure appears capable of successfully operating in arctic areas, certain problems may arise in maintaining and servicing its mooring system during the ice forming seasons. That is, if an anchor on a catenary mooring line breaks loose while the surface is covered with thick sheets of ice or an anchor line, itself, breaks, there is no effective way to retrieve, replace, or reposition that anchor or anchor line since the use of an anchor handling vessel, necessary for such operations, is impractical if not impossible under these conditions. Therefore, if a floating hull is to be used in exploiting deep arctic offshore areas, a need exists for properly mooring the hull not only to provide the necessary stability for the hull but also provide for both routine and emergency maintainence of the mooring system even when the surface is covered with ice.

SUMMARY OF THE INVENTION

The present invention provides a structure for use in exploiting arctic offshore areas where floating ice masses are likely to be present during some portions of the year. The structure is comprised of a floating hull having ice-breaking capabilities which is moored in position by means of a plurality of vertical mooring means which extend from the hull to a point on the marine bottom directly under the hull. Means are provided for tensioning and relaxing the mooring means as the situation dictates.

More specifically, the present structure is comprised of a floating hull having downwardly sloping sides which are adapted to react against an approaching ice mass to apply a breaking force on the ice mass as it moves against the hull. The hull has a central conduit or "moonpool" therethrough from which a plurality of mooring means extend vertically downward to a base affixed to the marine bottom. The mooring means may be comprised of flexible lines, e.g. nylon, steel, or the like or they may be rigid conduits, e.g. drill pipe.

Means are provided within the moonpool for individually tensioning the mooring means to thereby draw the hull downward to a position below its normal buoyant position in the water. In seasons when there is little or no ice activity in the operating area, the mooring means are maintained at maximum tension to thereby provide a "stiff" moor for the hull which, in turn, substantially eliminates vertical movement of the hull due to surface wind and wave action. This provides a stable platform from which offshore drilling operations can be conducted.

During seasons of ice activity, tension on the mooring means can be relaxed when the hull is contacted by an ice mass to thereby provide the necessary compliance for the hull to rock upward against the ice mass until the downward forces generated by the rocking hull are sufficient to break the ice mass. This is accomplished by proper operation of the tensioning means in the moonpool or if nylon lines are used, partly by the inherent stretching capabilities of the lines themselves. Further, the inherent "stiffness" of the present structure, even when vertical mooring means are relaxed, limits the lateral displacement of the hull during an ice breaking operation as compared to the lateral movement that may occur with the softer mooring means previously used for this type of floating structure. In other words, due to the present mooring means, the hull has to move a shorter lateral distance to break an ice mass than did previous such structures. This is important, especially in drilling operations, where it is necessary to suspend operations and withdraw the drill string when lateral movement of the hull exceeds a safe distance. The present structure, by requiring less lateral movement of the hull to break an approaching ice mass, substantially decreases the number of instances where it becomes necessary to suspend drilling operations; usually suspension being required only in cases of extreme ice conditions.

Further, and equally as important, if repair or replacement of a mooring means is required, this operation can be carried out even when the surface is covered by ice since the lower ends of the mooring means are anchored directly below the hull and/or accessible through the moonpool on the hull.

BRIEF DESCRIPTION OF THE DRAWINGS

The actual operation and the apparent advantages of the invention will be better understood by referring to the drawings in which like numerals identify like parts and in which.

DESCRIPTION OF THE PREFERRED EMBODIMENT

Figure 1:
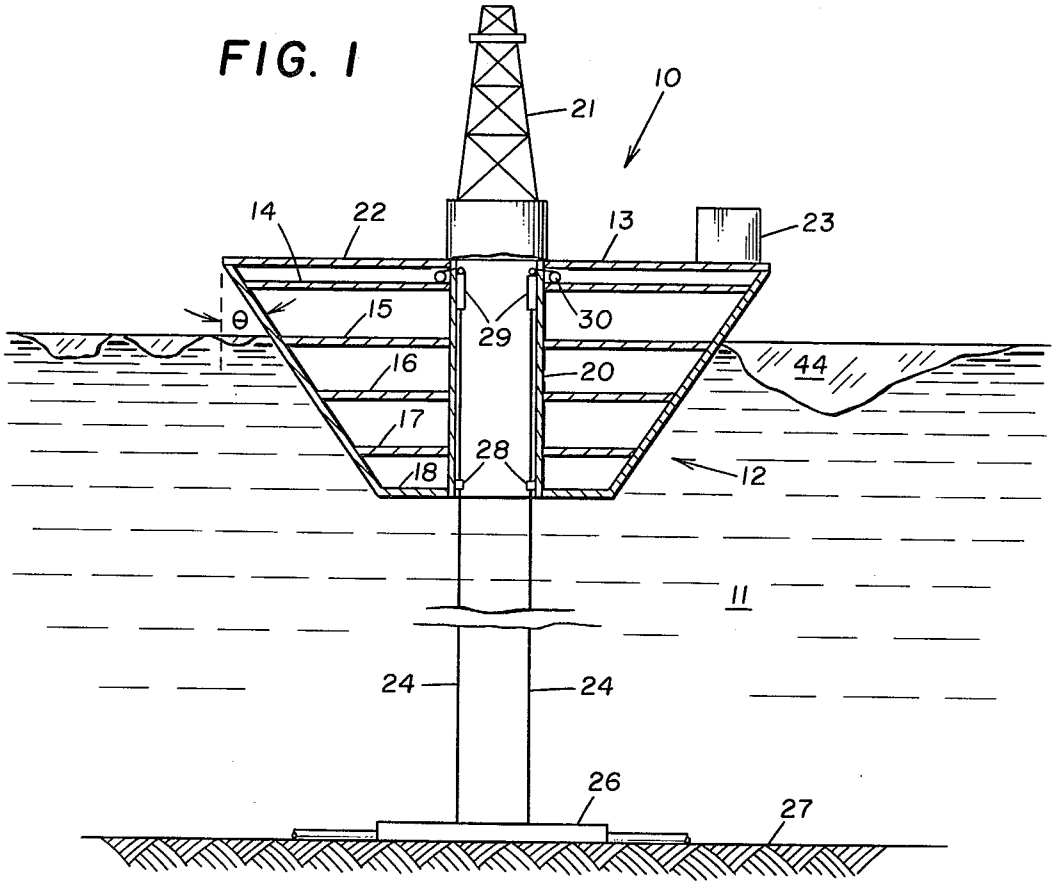
FIG. 1 is an elevational view, partly in section, of the present structure in an operable position at an offshore arctic location.

Referring more particularly to the drawings, FIG. 1 discloses an offshore structure 10 in an operable position in a deep arctic body of water 11. Structure 10 includes a floating hull 12 having a weather deck 13 thereon. Hull 12 is preferably constructed of steel plates using techniques normally employed in ship building. Hull 12 is a substantially hollow vessel except for ballast necessary to keep the hull in an upright and stable position. As illustrated, hull 12 has a plurality of internal decks 14, 15, 16, 17, 18 therein which in turn are preferably divided by vertical bulkheads (not shown) to provide for damage control.

Conduit 20 provides a vertical opening or "moonpool" through the center of hull 12. To keep the center of gravity as low as possible, all drilling and/or production equipment (not shown) is preferably positioned on the internal decks 14, 15, 16, 17, 18. Weather deck 13 preferably supports only derrick 21, heliport 22, and crew living quarters 23.

Hull 12, as illustrated, is constructed so as to have an inverted, frusto-conical shape. The angle $\theta$ of the downwardly sloping sides of hull 12 are acute enough to provide sufficient vertical force on an ice sheet to cause breakage (as will be discussed below) but are not so steep as to distort the structural configuration of hull 12. Angle $\theta$ may range between 30° and 60° with a preferred range of from 40° to 50°. Although the configuration of hull 12 is shown as being substantially frusto-conical, hull 12 could also be hyperbolically or parabolically shaped. The important criteria is that the sides of hull 12 which form the ice breaking portions of the structure should be tapered enough so that upon vertical movement of hull 12, the sides thereof will contact the ice mass with enough force to break the ice. Any configuration which permits the ice sheet to be broken by the downward acting movement of hull 12 is satisfactory.

Hull 12 is moored on position by means of a plurality of normally, substantially vertical mooring means 24. Although for the sake of clarity only two mooring means 24 are shown in FIG. 1, it should be understood that a substantially greater number will normally be used in the actual operations. Mooring means 24 may be comprised of substantially rigid conduits, e.g. drillpipe, or preferably be flexible lines, e.g. nylon or steel. Mooring means 24 are attached at their lower ends to base 26 which in turn is positioned on marine bottom 27. Preferably, base 26 is affixed to marine bottom 27 by means of piles (not shown) or the like. The upper ends of the mooring means 24 extend into moonpool 20, passing through guides 28 to tensioning means 29.

Figure 3:
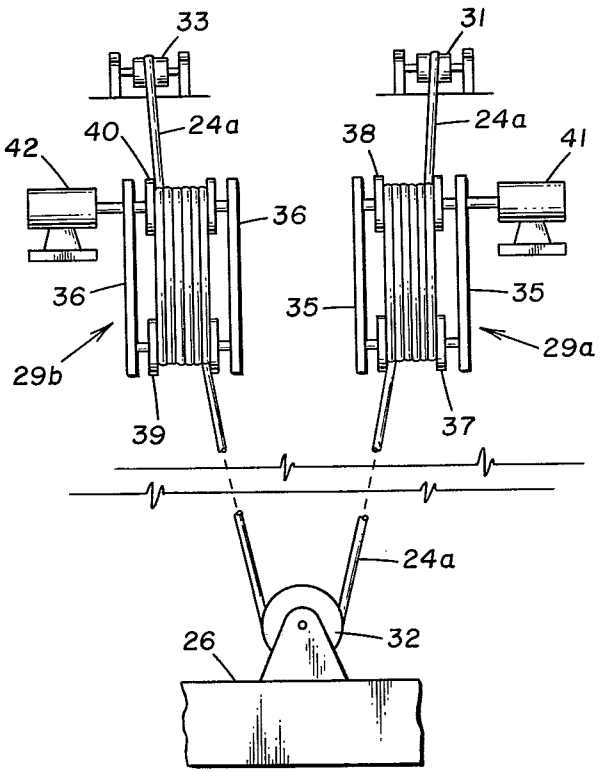
FIG. 3 is an elevational view of the tensioning means of FIG. 2.
Figure 2:
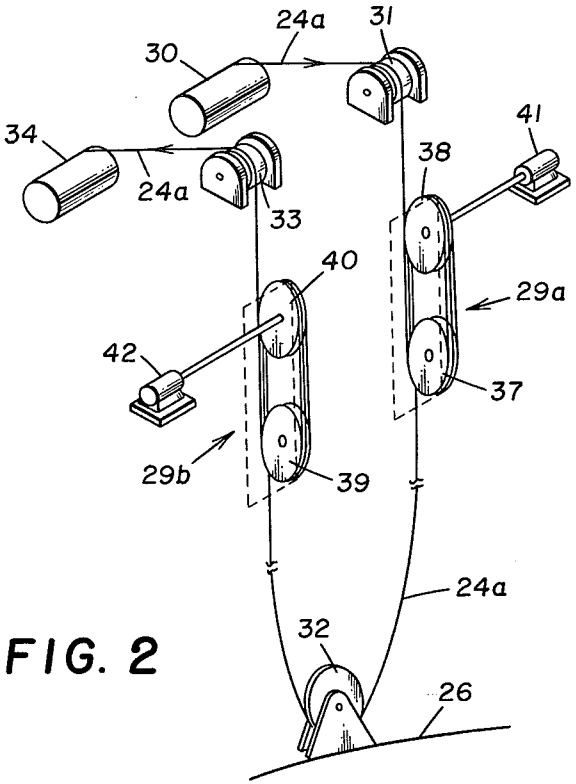
FIG. 2 is a schematical view of the tensioning means for a nylon line mooring means in accordance with the present invention.

In the modification shown in FIGS. 1, 2 and 3 mooring means 24 are comprised of nylon line 24*a* e.g. 6 to 8 inches in diameter. As best seen from the schematic in FIG. 2, line 24*a* is payed out from spool 30 on deck 14, over sheeve 31, through tensioning means 29*a*, down around sheeve 32 which is mounted on base 26, up through tensioning means 29*b*, over sleeve 33, and onto takeup spool 34. Referring now to FIG. 3, tensioning means 29*a* and 29*b* are identical and are comprised of a pair of spaced supports 35, 36, respectively, which are secured within conduit 20. Each pair of supports 35, 36 has two spaced pulleys 37, 38 and 39,40, respectively, journalled therein. Pulleys 38 and 40 are driven upon command by motors 41, 42, respectively. Both spools 30 and 34 are free-wheeling reels that are operated by winch motors (not shown) and have brake means for locking same against rotation to thereby provide anchorage for the ends of cable 24*a*.

In operation, hull 12 is positioned over base 26 and line 24*a* is threaded from playout spool 31 to takeup spool 34 as described above. The slack is initially taken out of line 24*a* by locking spool 31 and by rotating spool 34. Motor 42 and/or motor 41 is then operated to further tension line 24*a* thereby drawing hull 12 downward into water 12 to a position below its normal buoyant position. Any of line 24*a* fed through the tensioning means 29*b* is taken up on spool 34. The tensioning of lines 24*a* may be combined with the adding of extra ballast (e.g. seawater) to hull 12 to thereby aid in achieving the desired draft for hull 12.

During those times of the year when there is little or no ice in the operating area, lines 24*a* will remain in the maximum tensioned condition to provide a "stiff" mooring system for hull 12. This allows hull 12 to function as a stable platform for drilling operations in that any vertical movement due to wind or wave action is substantially eliminated. When ice forms and the resulting ice masses 44 (FIG. 1) begin to move into contact with hull 12, the natural resiliency or stretch in nylon lines 24*a* allows hull 12 to rock or slightly ride upward onto the approaching ice until forces due to the weight of hull 12, and the resiliency of lines 24*a*, is sufficient to break the ice which is in contact with hull 12. For a more detailed discussion as to the ice breaking capabilities of this type of structure and how the ice breaking is actually accomplished, see U.S. Pat. No. 4,043,943. The rocking or heaving of hull 12 against lines 24*a* can be supplemental by paying out extra line 24*a* from spool 30 and/or by initially removing ballast as hull 12 rises and adding ballast as it moves downward under the resiliency of lines 24*a*.

Since continuous stretching and relaxing of lines 24a may eventually adversely affect the resiliency of the nylon lines 24a, it may be necessary to pay out new line from spool 30. This can easily be done by rotating spools 30 and 34. When the supply of line 24a on spool 30 is exhausted, a complete new length of line can be substituted for an existing line by splicing the new line from a new supply spool to the end of the old line and then threading the new line through to spool 34 by merely drawing the old line through the system.

Figure 4:
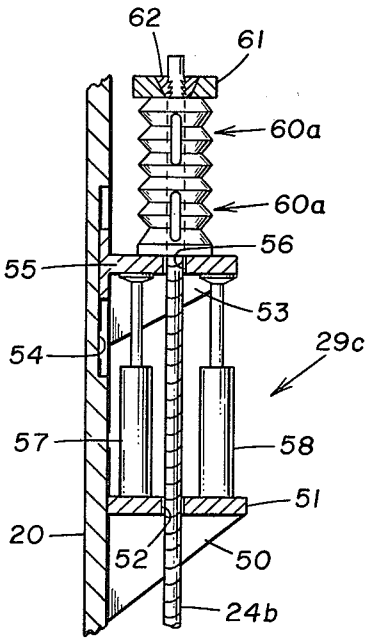
FIG. 4 is an elevational view, partly in section, of a tensioning means used for rigid conduit or steel cable mooring means in accordance with the present invention.

Referring now to FIG. 4, a modification of tensioning means 24 is illustrated. Tensioning means 29c is used then either rigid conduits (not shown) or steel cables 24b are used. Tensioning means 29c, as illustrated, is comprised of a fixed support 50 which is secured within conduit 20. Support 50 has a plate 51 having an opening 52 therethrough through which cable 24b can easily pass. Sliding support 53 is slidably mounted for limited movement in slot 54 formed in conduit 20 and has a plate 55 having opening 56, through which cable 24b passes. Hydraulic means, shown as hydraulic cylinders 57, 58, are positioned between plates 51 and 55 and are affixed thereto to provide a means for moving support 54 in relation to support 50.

Cylinders 57, 58 are interconnected with the respective cylinders (not shown) of all of the other tensioning means 29c which are positioned around conduit 20 so that when an ice mass contacts hull 12 and thereby applies a force thereto, cables 24b on the side of the approaching ice mass may be extended while any slack in cables 24b on the opposite side may be taken up by the coordinated operation of the respective hydraulic cylinders. This action allows hull 12 to rock about its horizontal axis which produces a beneficial action in regard to breaking the contacting ice mass.

Further, hydraulic cylinders 57, 58 by means of a pressure control means (not shown) provide a primary safety mechanism to limit forces below those necessary to break cables 24b and also, limits the tilt of hull 12 during the rocking action described above. That is, when the force in cables 24b exceed a predetermined load, the cylinders will bleed to allow limited movement of hull 12 with respect to cables 24b to prevent the breaking thereof.

Positioned on plate 55 is secondary safety means 60 which is shown as one or more (two shown) stacked, rigid bellows-like, slotted cylinders 60a which are designed to collapse upon the application of a predetermined load. Cable 24b passes through cylinders 60a and through a plate 61. Wedges 62 cooperate with inclined surfaces through plate 61 to lock cable 24b to plate 61. If rigid conduit is used instead of cable, tensioning means 29c is identical except a nut (not shown) is threaded onto the upper end of the rigid conduit to secure the rigid conduit to tensioning means 29c in place of plate 61 and wedges 62.

In operation, the lower ends of the rigid conduit or steel cable 24b are connected by means of releasable connections, e.g. stab-in connections (not shown) to base 26. With hydraulic cylinders 57, 58 in their retracted positions, the upper ends of the rigid conduit or steel cable 24b are secured to a respective tensioning means 29c. Hydraulic cylinders 57, 58 are actuated to move support 55 upward thereby tensioning the rigid conduit or steel cable 24b to thereby draw hull 12 downward into water 11 to a position lower than the normal buoyant position of hull 12. Again, proper ballasting of hull 12 can be combined into this operation. In this position, hull 12 forms a stable platform capable of carrying out drilling operations.

When an ice mass contacts hull 12, operation of respective hydraulic cylinders 57, 58, as described above provides the compliance necessary for hull 12 to rock and/or heave to thereby develop force to break the ice mass. Again, if needed, ballast can be removed from hull 12 as it rocks upward and can be added as it rocks downward to aid in breaking the ice. Further, hydraulic cylinders 57, 58 may be actuated as hull 12 rocks downward to retension cables 24b and to add positive force to the ice breaking operation.

If for some reason the ice mass moves hull 12 a distance exceeding the normal travel range for cable 24b and cylinders 57, 58, the continuing force on the cable 24b will cause safety bellows 60a to collapse thereby allowing additional travel without breaking cables 24b. Bellows 60a are preferably made in lengths, e.g. 1 meter, so that several may be stacked to provide for a maximum desired safety travel factor for a particular hull 12. Although a hydraulic means is shown, other means such as short-stroke jacks (not shown) may also be used to move support 53 relative to support 50.

It can be seen from the above description, that a structure is provided that not only can be stiffly moored in an offshore arctic region in months when there is little or no surface ice activity to provide a stable platform required for drilling operations, but also can compensate for moving ice masses when the situation arises. Further, and equally as important, by having the lower ends of the mooring lines anchored directly below hull 12, any repair or replacement of a line can be effected relatively easy by means of a diving bell, divers where permitted, or remotely from hull 12 through conduit 20 even when the surface is covered with moving ice masses.

What is claimed is:

1. An offshore structure adapted for operating in a body of water containing floating ice masses at least part of the year, said structure comprising:

a floating hull having downwardly and inwardly sloping sides adapted for breaking said ice masses when contacted thereby;

a conduit extending vertically and centrally through said hull;

mooring means connected to said hull and extending substantially vertically from said conduit to the marine bottom underlying said hull;

means for anchoring said mooring means to said marine bottom directly below said hull; and means on said hull for tensioning said mooring means and maintaining said hull downwardly in said body of water at a position below said hull's normal buoyant position when ice mass is not of concern, and for relaxing tension on said mooring means when desirable to rock said hull against an ice mass.

2. The offshore structure of claim 1 wherein said mooring means comprises:

a plurality of substantially elastic, nylon lines each of which is capable of stretching when a predetermined load is applied thereto.

3. The offshore structure of claim 2 wherein said tensioning means comprises a plurality of individual tensioning means, one for each of said plurality of nylon lines, each of said individual tensioning means comprising:

a payout spool onto which one end of said each nylon line is stored; and a takeup spool onto which the other end of said each nylon line is stored;

and wherein said means for anchoring said mooring means to said marine bottom comprises:

a base on said marine bottom; and an individual sheeve mounted on said base for each of said plurality of nylon lines over which said other end of said each nylon line is passed before said other end is stored on said takeup spool.

4. The offshore structure of claim 3 wherein said tensioning means further comprises:

a pair of spaced pulleys mounted on said hull over which said other end of said each nylon line is threaded before said other end is stored on said takeup spool; and means for driving one of said pairs of pulleys.

5. The structure of claim 1 wherein said mooring means comprises:

a plurality of steel cables.

6. The structure of claim 5 wherein said tensioning means comprises a plurality of individual tensioning means one for each of said plurality of steel cables, each individual tensioning means comprising:

a first support fixed to said hull with an opening through which said each steel cable passes;

a second support slidably mounted on said hull above said second support;

means for attaching said each steel cable to said second support; and means for moving said second support relative to said first support.

7. The offshore structure of claim 6 wherein said means for attaching said each steel cable to said second support comprises:

collapsible means positioned on said second support over an opening in said second support through which said each steel cable passes, said collapsible means adapted to fail upon the application of a predetermined load thereon, and means for securing said each steel cable to said collapsible means whereby upon application of said predetermined load, said collapsible means collapses to allowed limit movement between said each steel cable and said second support.

8. The offshore structure of claim 1 including:

a conduit passing vertically through the center of said hull and affixed thereto to thereby form an opening therethrough;

and wherein:

said means for tensioning said mooring means is affixed in said conduit.

9. The offshore structure of claim 1 wherein said mooring means comprises:

a plurality of rigid conduits.

10. A method of using an offshore structure in a body of water containing ice masses at least part of the year said offshore structure comprising a floating hull having downwardly and inwardly sloping sides adapted for breaking ice masses when contacted thereby said method comprising:

anchoring said structure to the marine bottom with mooring means directly below said hull;

maintaining said hull downwardly in said body of water at a position below the normal buoyant position of said hull when ice masses are not of concern; and relaxing tension on said mooring means when desirable to rock said hull against an ice mass.

* * * * *